US005339597A

United States Patent [19]

Naka et al.

[11] Patent Number: 5,339,597

[45] Date of Patent: Aug. 23, 1994

[54] WORK HEAD CHANGER FOR ROTARY VESSEL PROCESSING SYSTEM

[75] Inventors: Toshiaki Naka; Akira Motomura; Hidefumi Akamaru, all of Ishikawa, Japan

[73] Assignee: Shibuya Kogyo Co., Ltd., Ishikawa, Japan

[21] Appl. No.: 16,799

[22] Filed: Feb. 11, 1993

[30] Foreign Application Priority Data

May 29, 1992 [JP] Japan ..... 4-163632

[51] Int. Cl.[5] ..... B65B 59/00; B65B 3/10; B65B 7/28

[52] U.S. Cl. ..... 53/167; 53/201; 53/306; 141/84; 141/144; 483/69

[58] Field of Search ..... 53/167, 201, 306, 276, 53/52; 141/84, 144, 145; 483/900, 69, 39

[56] References Cited

U.S. PATENT DOCUMENTS

| | | | |
|---|---|---|---|
| 2,359,932 | 10/1944 | Newey | 53/201 |
| 2,528,644 | 11/1950 | Dunn | 141/84 |
| 3,276,116 | 10/1966 | Stark | 483/39 X |
| 3,470,667 | 10/1969 | David et al. | 53/201 |
| 3,524,294 | 8/1970 | Koll | 53/201 X |
| 3,537,231 | 11/1970 | Dimond | 53/201 |
| 3,640,397 | 2/1972 | Ollearo | 483/39 X |
| 3,660,963 | 5/1972 | Sullivan | 53/201 X |
| 4,077,441 | 3/1978 | Rosen et al. | 141/84 X |
| 4,173,104 | 11/1979 | Koll | 53/201 |
| 4,715,147 | 12/1987 | Millay et al. | 483/69 X |
| 4,827,599 | 5/1989 | Winkler et al. | 483/900 X |
| 4,830,210 | 5/1989 | Mabille . | |
| 4,831,721 | 5/1989 | Hirai et al. | 483/69 X |
| 4,845,834 | 7/1989 | Watson | 483/39 X |
| 5,074,028 | 12/1991 | Strasser | 483/900 X |
| 5,101,548 | 4/1992 | McMurtry et al. | 483/69 X |
| 5,133,128 | 7/1992 | Katayama et al. | 483/39 X |

FOREIGN PATENT DOCUMENTS 3-85290 4/1991 Japan .

*Primary Examiner*—Horace M. Culver
*Attorney, Agent, or Firm*—Flynn, Thiel, Boutell & Tanis

[57] ABSTRACT

A work head changer is disclosed which automatically changes a capping head used in a rotary multicapper or a filling nozzle in a rotary filler. A controller controls the rotation of a rotatable body of the rotary multicapper, for example, thus bringing the individual capping heads to a stop successively and intermittently at a predetermined work head replacement position. In case of the rotary multicapper, each capping head is detachably mounted on the rotatable body through a connection. A work head delivery mechanism removes a capping head which is brought to a stop at the work head replacement position from the connection, and attaches a capping head of another variety which has been stored in a stocker to the connection at an empty location from which the capping head has been removed.

20 Claims, 13 Drawing Sheets

24
25
22a
25
23
27
27
22
21
26
28
16
14
15
16
18a
18a
11
14
18
13c
12
2
26a
17
13b
13
13a
13d
101
101
101
101
101
101

202
204
205
201
203

WORK HEAD CHANGER FOR ROTARY VESSEL PROCESSING SYSTEM

FIELD OF THE INVENTION

The invention relates to a rotary vessel processing system, and more particularly, to a work head changer for a rotary vessel processing system such as a rotary multicapper or rotary filling machine or the like.

DESCRIPTION OF THE PRIOR ART

A rotary multicapper is disclosed, for example, in Japanese Laid-Open Patent Application No. 85,290/1991, where the multicapper comprises a rotatable body for conveying vessels at a given interval, a plurality of capping heads, operating as work heads, disposed on the rotatable body as circumferentially spaced apart at an equal interval for applying a capping operation to each of vessels as they are conveyed by the rotatable body, and a connection between the rotatable body and each capping head to allow an engagement and a disengagement therebetween so as to mount the respective capping heads on the rotatable body in a detachable manner.

In a multicapper of the kind described, the capping head may be dismounted from the connection and replaced by another capping head for a screw cap, PR cap or a crown, thus permitting a variety of caps to be applied to the vessels.

Also in a rotary filling machine, a filling nozzle, serving as a work head, is replaced in accordance with the configuration of the vessel or the size of a mouth opening, or a filling nozzle may be changed depending on the content to be filled such as if it contains carbonate gas or not.

However, in a conventional rotary vessel processing system such as a rotary multicapper or rotary filling machine as mentioned above, all of the work heads are replaced by a manual operation, and thus the replacement is labor intensive.

SUMMARY OF THE INVENTION

Accordingly, the present invention provides a work head changer for a rotary vessel processing system which permits the labor of workers to be alleviated.

Specifically, the invention relates to a rotary vessel processing system including a rotatable body for conveying vessels at a given interval, a plurality of work heads circumferentially spaced apart upon the rotatable body at an equal interval for applying a capping or filling operation to each of vessels as they are conveyed by the rotatable body, and a connection between the rotatable body and the respective work heads to allow an engagement and a disengagement therebetween so as to mount each work head on the rotatable body in a detachable manner.

In accordance with the invention, a work head changer for the rotary vessel processing system comprises a controller for controlling the rotation of the rotatable body so as to stop each of the work heads successively and intermittently at a predetermined work head replacement position, and a work head delivery mechanism for removing a work head which comes to a stop at the work head replacement position from the connection and for mounting a new work head to the connection at an empty position where the work head has previously been removed.

With this arrangement, the controller controls the rotation of the rotatable member to stop each work head successively and intermittently at a predetermined work head replacement position, and the work head delivery mechanism then removes the work head which has come to a stop at the work head replacement position from the connection and mounts a new work head to the emptied position of the connection. In this manner, workers are not required to replace the work heads, thus drastically reducing the labor which has been required for the changing operation.

Above and other objects and effects of the invention will become apparent from the following description of several embodiments thereof with reference to the drawings.

DETAILED DESCRIPTION OF EMBODIMENTS

Figure 1:
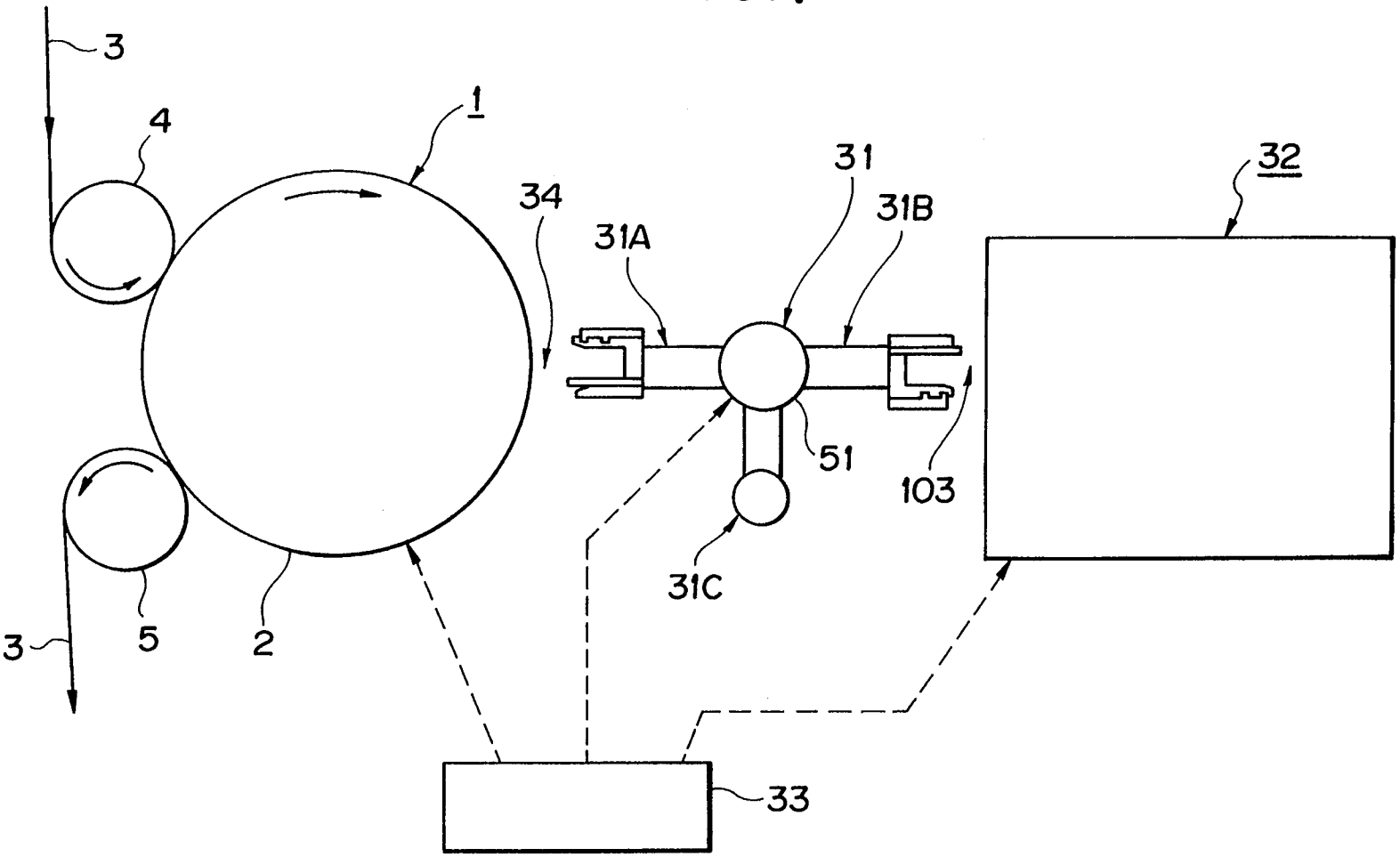
FIG. 1 is a schematic view, generally in the form of a plan view, of one embodiment of the invention.

An embodiment of the invention as applied to a rotary multicapper will now be described. Referring to FIG. 1, a rotary multicapper 1 includes a rotatable body 2, and vessels which are conveyed by a conveyor 3 are handed within the rotatable body 2 by an inlet star wheel 4. Vessels which have been capped by the rotary multicapper 1 are handed off by an outlet star wheel 5 to be returned to the conveyor 3 again.

Figure 2:
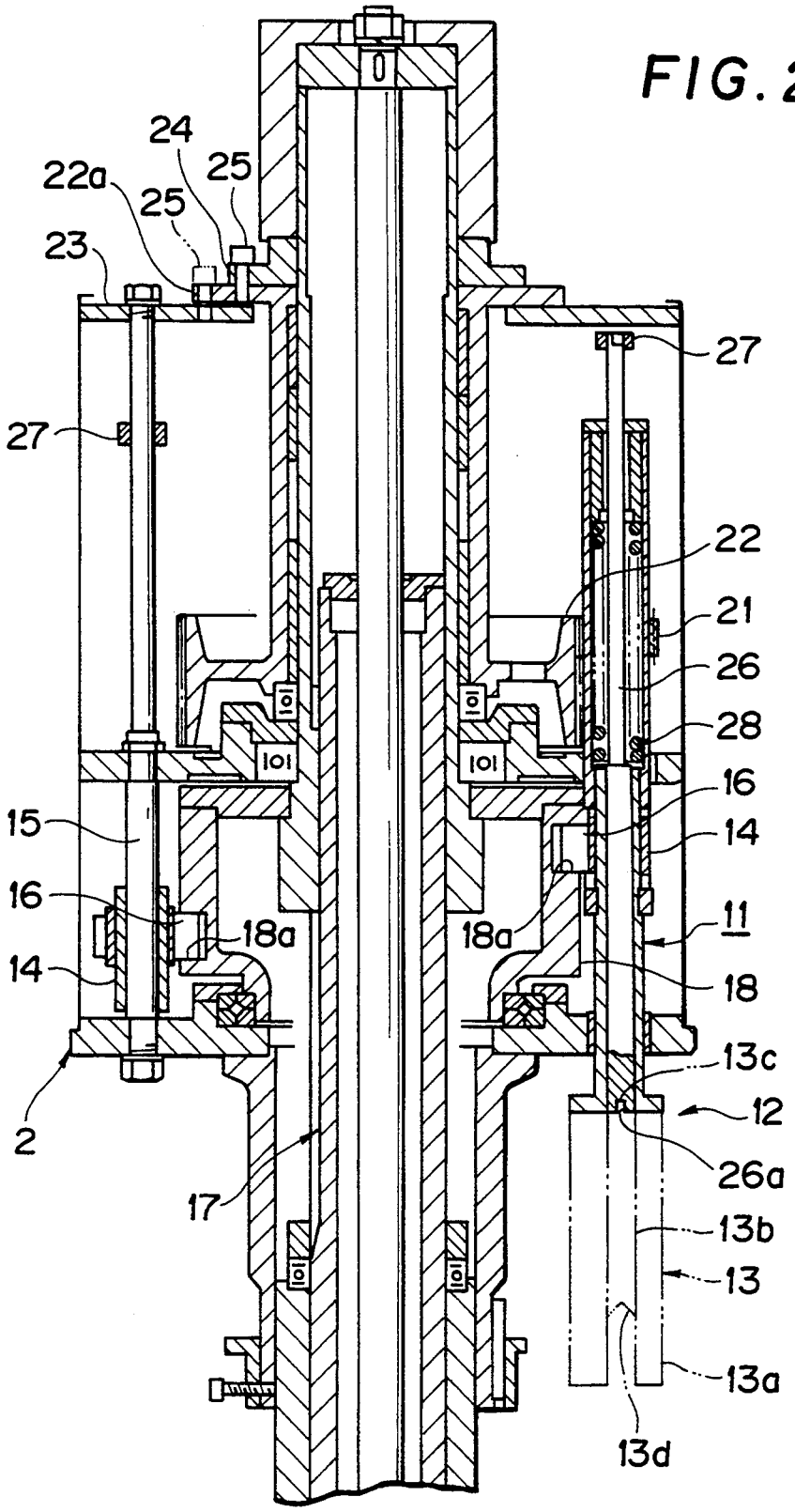
FIG. 2 is a longitudinal section of a rotary multicapper 1.

As shown in FIG. 2, around its periphery, the rotatable body 5 has spindles 11 which are disposed to be elevatable and rotatable and which are circumferentially spaced apart at an equal interval. A capping head 13 is detachably attached to the lower end of each spindle 11 through a connection 12. The capping head 13 may be one which allows a PP cap to be applied to a vessel.

One end of a bracket 14 is rotatably mounted around a lower portion of each spindle 11, and the other end of each bracket 14 is engaged with a guide rod 15, which is fixedly mounted on the rotatable body 2 at a position intermediate the respective spindles 11, in an elevatable manner, whereby the bracket 14 cannot rotate with the spindle 11. A cam follower 16 is mounted on the bracket 14 and engages a cam groove **18*a* formed in an elevating cam 18 which is secured to a stationary shaft 17, thus allowing the spindle 11 to be moved up and down as the rotatable member 2** rotates.

The spindle 11 is formed with a gear 21 intermediate its length, which meshes with a drive gear 22 which is in turn rotatably mounted with respect to the stationary shaft 17 and the rotatable member 2. The drive gear 22 integrally carries a radially outwardly extending flange 22*a* at its top end, which is rotatably interposed between a top disc 23, which forms the rotatable body 2, and a radial flange 24 which is integrally formed with the stationary shaft 17.

In the present embodiment, the rotary multicapper 1 is intended to be used as a PP capper, and accordingly, it is necessary to cause the capping head 13 to rotate about its own axis. At this end, a connection pin 25 extends through the radial flange 24 of the stationary shaft 17 and the flange 22*a* of the drive gear 22 to connect them integrally together, thus securing the drive gear 22 to the stationary shaft 17. In this instance, as the rotatable body 2 rotates, the gear 21 meshing with the drive gear 22 which is secured is effective to allow the respective spindles 11 and their attached capping heads 13 to rotate while revolving around the stationary shaft 17.

When the capper is to be used as a stationary capper such as a crowner, the connecting pin 25 may extend between the flange 22*a* of the drive gear 22 and the top disc 23 of the rotatable body 2 to connect them together integrally so that the drive gear 22 may rotate integrally with the rotatable body 2. In this instance, the rotation of the spindle 11 and its attached capping head 13 is prevented by the gear 21 which meshes with the drive gear 22 integral with the rotatable body 2, and hence the spindle and the capping head merely revolve around the stationary shaft 17 in integral manner with the rotatable body 2.

As is well known in the art, the capping head 13, which is to be used as PP or roll-on capper, comprises an outer peripheral portion 13*a* which is detachably connected to the spindle 11 and is driven for rotation by the spindle 11 to form threads in the outer periphery of a PP cap, not shown, and a pressure block 13*b* which is disposed in the shunk portion of the outer peripheral portion 13*a*, the pressure block 13*b* being required to be pressed against a vessel so that the PP cap cannot rotate relative to the vessel.

At this end, an elevating rod 26 is elevatably and rotatably fitted inside each spindle 11, and a bracket 27 secured to the top end of the rod 26 is engaged with the guide rod 15 mentioned above in an elevatable manner so that the elevating rod 26 cannot rotate relative to the rotatable body 2. In addition, a projection 13*c* formed on the top end of the pressure block 13*b* is detachably fitted into a slit 26*a* formed in the lower end of each elevating rod 26, thus preventing the pressure block 13*b* from rotating. The elevating rod 26 is normally urged by a spring 28, acting as urging means, at its downmost end position relative to the spindle 11.

In the rotary multicapper 11 constructed in the manner mentioned above, since the drive gear 22 is secured to the stationary shaft 17 by the connecting pin 25, as the rotatable body 2 is rotated by a motor, not shown, the spindle 11 revolve around the stationary shaft 17 in an integral manner with the rotational body 2, whereby the cam follower 16 engaged with the cam groove 18*a* formed in the elevating cam 18 mounted on the stationary shaft 17 causes the spindle 11 to move up and down while the gear 21 meshing with the secured drive gear 22 causes the spindle 11 to rotate.

Accordingly, the outer peripheral portion 13*a* of the capping head 13 attached to the spindle 11 moves up and down while rotating, while the pressure block 13*b* of the capping head 13 is prevented from rotating relative to the rotatable body 2 as it is detachably connected to the elevating rod 26. Accordingly, a PP cap can be applied to a vessel in the similar manner as in a conventional PP capper well known in the art.

Returning to FIG. 1, a work head delivery mechanism 31 and a stocker 32 are disposed adjacent to the multicapper 1, and the operation of the rotary multicapper 1, the work head delivery mechanism 31 and the stocker 32 can be controlled by a controller 33.

When changing the capping head 13 on the rotary multicapper 1, the controller 33 controls the rotation of the rotatable body 2, while detecting the angular position of the rotatable body 2 as by a sensor such as a rotary encoder or the like, not shown, and can stop the respective capping heads 13 at a predetermined work head replacement position 34 in a given sequence, successively and intermittently.

At the same time, the controller 33 controls the operation of the work head delivery mechanism 31 and the stocker 32 so that the work head delivery mechanism 31 removes the capping head 13 from the connection 12 while the stocker 32 takes out a capping head of a different kind, which is stored therein, and mounts the capping head which is taken out from the stocker 32 in the emptied connection 12 from which the old capping head 13 has been removed while simultaneously storing the capping head 13 which is removed from the connection 12 within the stocker 32.

Figure 5:
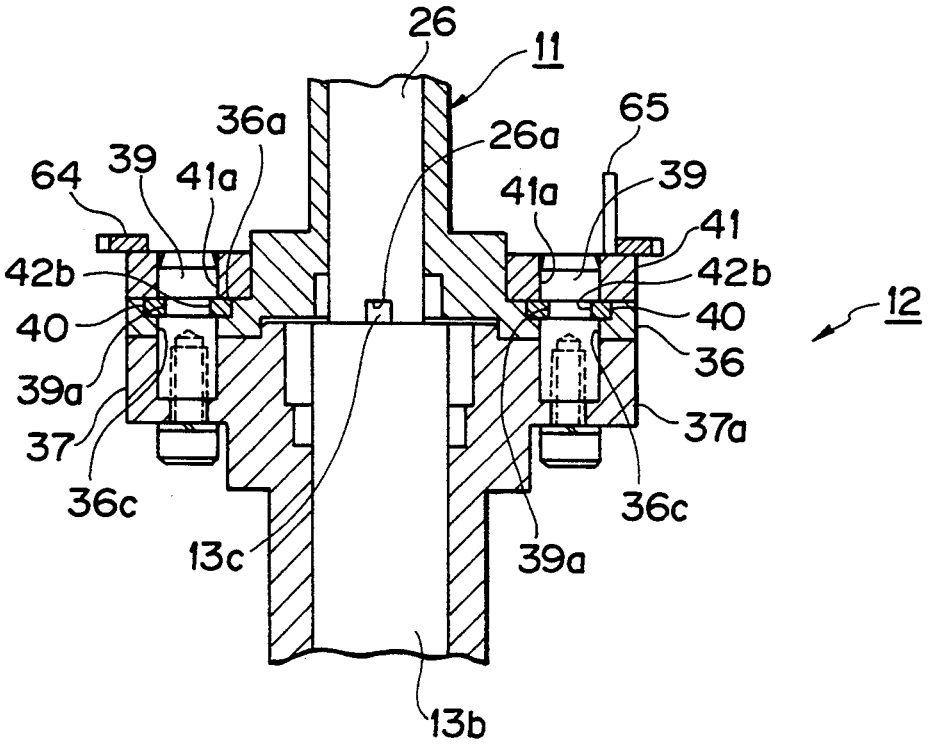
FIG. 5 is another section of the connection 12, as taken through a plane which is displaced 90° from FIG. 3.

The connection 12 which detachably connects the spindle 11 and the capping head 13 will be more specifically described. Referring to FIG. 5, the lower end of the spindle 11 and the top end of the capping head 13 are provided with flanges 36, 37, respectively, which are disposed in overlapping relationship with respect to each other.

Figure 6:
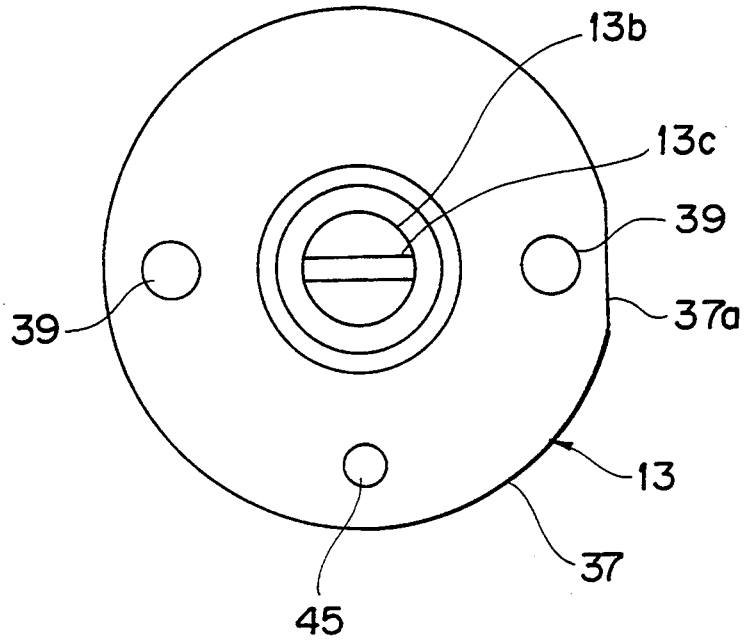
FIG. 6 is a plan view of a capping head 13.

As shown in FIG. 5, the flange 37 of the capping head 13, which is located on the downside, has a pair of connecting pins 39 fixedly mounted in its upper surface at diametrically opposite positions (see FIGS. 4 and 6), with the connecting pin 39 being formed with a portion 39*a* of a reduced diameter at its intermediate elevation.

On the other hand, the flange 36 of the spindle 11 is formed with an annular groove 36*a* in its upper surface, in which a ring-shaped connection plate 40 is rotatably received as aligned with the axis of the spindle 11. An annular fixing plate 41 is placed on top of the flange 36 and the connection plate 40 and is secured to the spindle 11, whereby the connection plate 40 is rotatably held between the flange 36 and the fixing plate 41.

Figure 7:
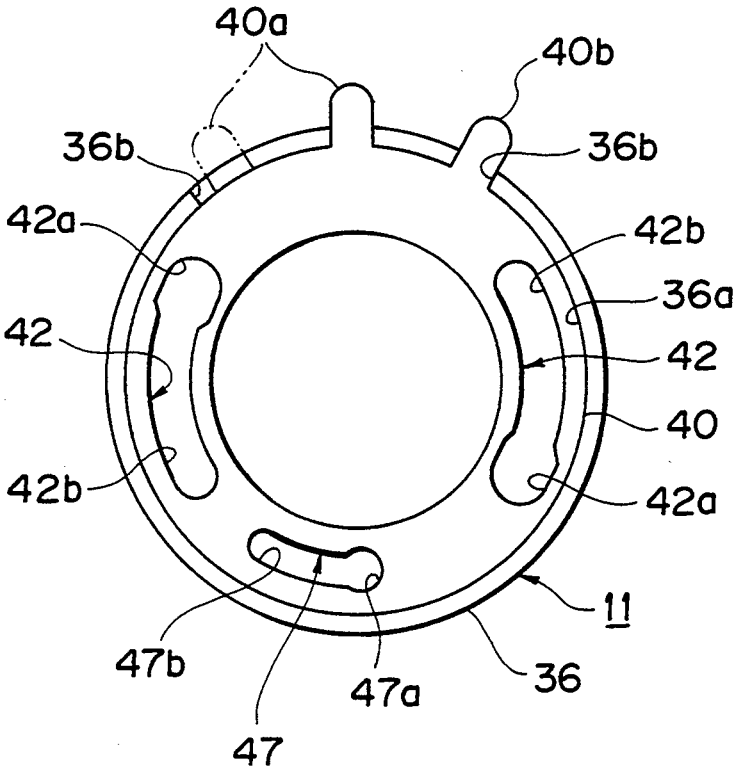
FIG. 7 is a plan view showing a relationship between a connection plate 40 and a spindle 11.

As shown in FIG. 7, the periphery of the connection plate 40 is formed with a pair of radially outwardly extending projections 40*a*, 40*b*, which extend through a notch 36*b* formed in the flange 36 of the spindle 11 from within the annular groove 36*a* to the exterior thereof. Accordingly, the connection plate 40 can be angularly moved within an extent defined by the notch 36*b* by means of the both projections 40*a*, 40*b*.

The connection plate 40 is also formed with a pair of connection holes 42, each of which includes a widened section 42*a* and a narrowed section 42*b* of a width which is substantially equal to the diameter of the reduced diameter portion 39*a* of the connection pin 39.

Figure 4:
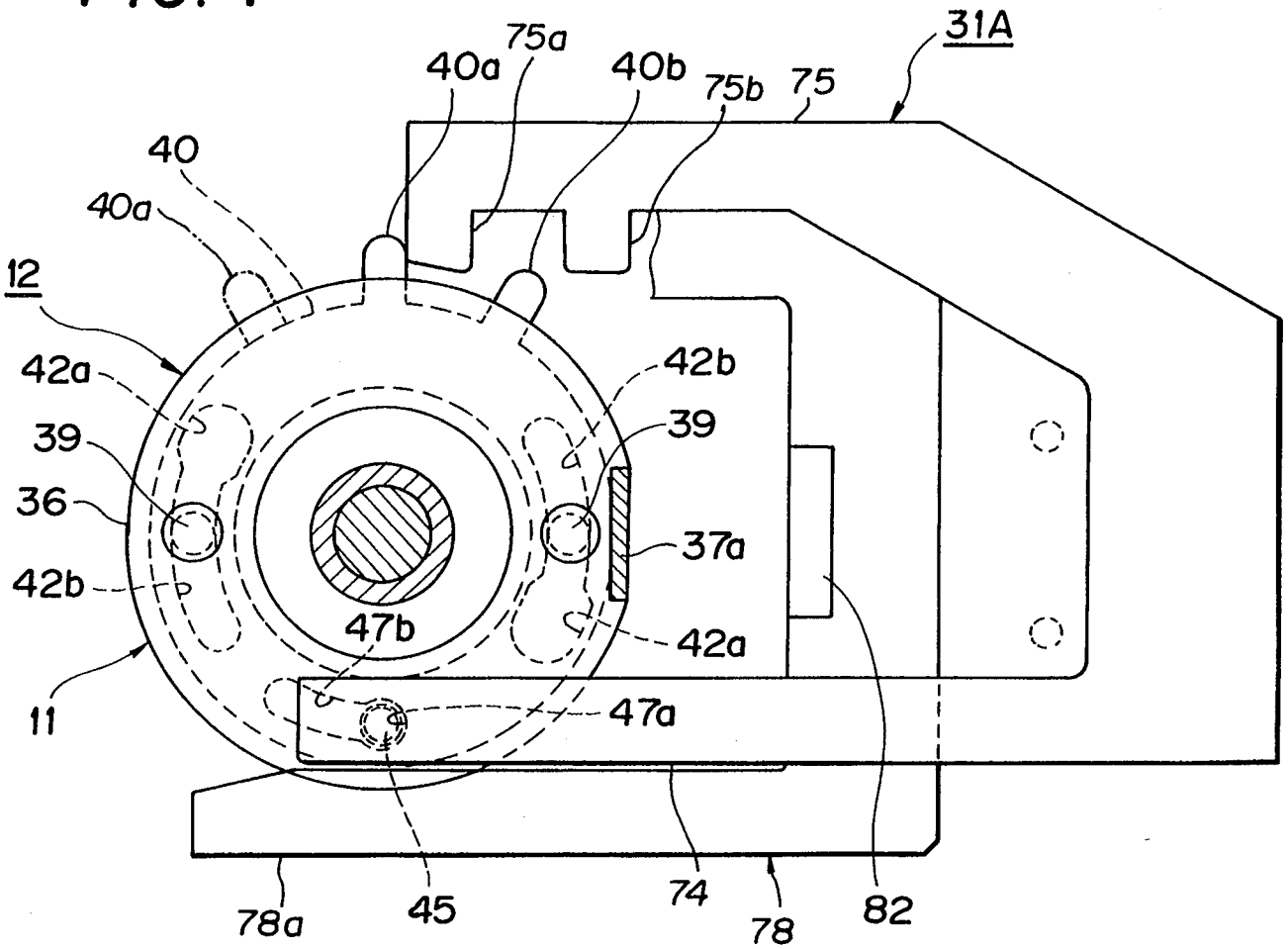
FIG. 4 is a top view of a connection 12 and a free end portion of a first delivery mechanism 31A.

Referring to FIG. 5, the flange 36 and the fixing plate 41 which hold the connection plate 40 sandwiched therebetween are formed with through-openings 36*c* and 41*a*, respectively, through which the connection pin 39 extends, at positions assumed by the widened section 42*a* of the connection holes 42 when the connection plate 40 is rotated counter-clockwise as viewed in FIGS. 4 and 7 to bring one of the projections, 40*a*, to one end of the notch 36*b*, as indicated by phantom lines in FIGS. 7 and 4.

Accordingly, when attaching the capping head 13 to the lower end of the spindle 11, the projection 40*a* is initially positioned at a location indicated by phantom lines in FIG. 4 so as to locate the widened section 42*a* of the connection hole 42 formed in the connection plate 40 in alignment with the axis of the through-openings 36*c*, 41*a* formed in the flange 36 and the fixing plate 41, respectively.

Under this condition, the capping head 13 is raised so that the connection pin 39 fixedly mounted in the upper end flange 37 may be passed through the through-openings 36*c*, 41*a* and the widened section 42*a* of the connection hole 42. An arrangement is made such that when the flange 36 of the spindle 11 and the flange 37 of the capping head 13 are in contact with each other in this manner, the elevation of the reduced diameter portion 39*a* of the connection pin 39 is aligned with the elevation of the connection plate 40, and accordingly, under this condition, the projections 40*a*, 40*b* may be utilized to rotate the connection plate 40 clockwise, as viewed in FIG. 4, thus bringing the projection 40*b* to the other end of the notch 36*b* (the solid line position shown in FIGS. 7 and 4), allowing the narrowed section 42*b* of the connection hole 42 to be engaged with the reduced diameter portion 39*a* of the connection pin 39.

Under this condition, the connection pin 39 is supported by the both sides of the narrowed section 42*b* of the connection plate 40 and cannot be displaced in the downward direction, so that the capping head 13 can be attached to the lower end of the spindle 11. When removing the capping head 13 from the spindle 11, the projections 40*a*, 40*b* may be utilized to rotate the connection plate 40 counter-clockwise, as viewed in FIG. 4, until the projection 40*a* is returned to its original position.

When performing a capping operation with the capping head 13 attached to the spindle 11 in the manner mentioned above, it is necessary to cause an integral rotation of the spindle 11 and the capping head 13. In accordance with the invention, lock means is provided for preventing a relative rotation of the connection plate 40 with respect to the spindle 11 and the capping head 13.

Figure 3:
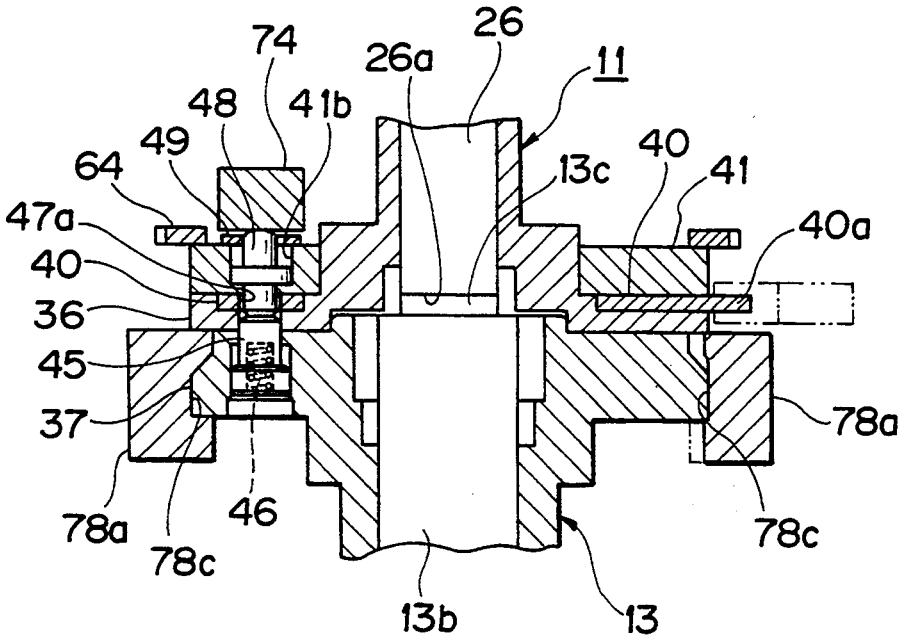
FIG. 3 is a section of a connection 12.

Specifically, referring to FIGS. 3 and 4, the flange 37 of the capping head 13 is provided with a lock pin 45 which is angularly displaced by 90° from the pair of connection pins 39 and which is substantially diametrically opposite to the pair of projections 40*a*, 40*b*, and the lock pin 45 is normally urged upward by a spring 46. As shown in FIGS. 4 and 7, the connection plate 40 is formed with a lock hole 47 in alignment with the lock pin 45. The lock hole 47 includes a through-opening 47*a* of a diameter which is substantially equal to the external diameter of the lock pin 45, and a narrowed section 47*b* of a width less than the external diameter of the lock pin 45.

The through-opening 47*a* is formed to be positioned on the axis of the lock pin 45 when the connection plate 40 is rotated clockwise to bring the projection 40*b* to the terminal end of the notch 36*b* to allow the narrowed section 42*b* of the connection hole 42 to be engaged with the reduced diameter portion 39*a* of the connection pin 39. In other words, the lock pin 45 is designed to move into and engage the through-opening 47*a* in the lock hole 47 by passing through the through-opening 36*d* formed in the flange 36 of the spindle 11 when the capping head 13 is attached to the spindle 11, whereby a rotation of the connection plate 40 relative to the spindle 11 and the capping head 13 is prevented.

On the other hand, as illustrated in FIG. 3, an eject pin 48 is elevatably formed at a position directly above the lock pin 45 engaged with the through-opening 47*a* in order to release the engagement between the lock pin 45 and the through-opening 47*a*. The eject pin 48 is elevatably disposed in a stepped opening 41*b* formed in the fixing plate 41, and its lower end has an external diameter which is substantially equal to the width of the narrowed section 47*b* of the lock hole 47.

When the lock pin 45 is urged upward by the spring 46 to be engaged with the through-opening 47*a*, the eject pin 48 bears against the lock pin 45 and is also raised upward together with the lock pin. Under this condition, the upper end of the eject pin 48 extends through and projects above a lid 49 which closes the stepped opening 41*b* to prevent the eject pin 48 from being disengaged from within the stepped opening 41*b*.

Under this condition, the lock pin 45 is engaged with the through-opening 47*a* as mentioned above, so that the connection plate 40 cannot rotate relative to the spindle 11 and the capping head 13, and accordingly, the engagement of the narrowed section 42*b* of the connection hole 42 with the reduced diameter portion 39*a* of the connection pin 39 is maintained, thus preventing the disengagement of the capping head 13 from the spindle 11.

On the other hand, when removing the capping head 13 from the spindle 11, the eject pin 48 is depressed to force the lock pin 45 down against the resilience of the spring 46, whereby the engagement between the lock pin 45 and the through-opening 47*a* is terminated. Under this condition, the lower end of the eject pin 48 is located within the through-opening 47*a*, but since the lower end of the eject pin 48 has an external diameter which is substantially equal to the width of the narrowed section 47*b* of the lock hole 47, the connection plate 40 can be rotated counter-clockwise, as viewed in FIG. 4, by utilizing the projections 40*a*, 40*b*, thus allowing the capping head 13 to be removed from the spindle 11.

The work head delivery mechanism 31 will now be described. Referring to FIG. 1, the work head delivery mechanism 31 includes a first delivery mechanism 31A and a second delivery mechanism 31B which are disposed on the opposite sides of a centrally located drive shaft 51. The mechanism 31 also includes an angular positioning mechanism 31C, located intermediate the both delivery mechanisms 31A, 31B, for causing the connection 12 on the side of the spindle 11 which is stopped at the work head replacement position 34 to be oriented in a predetermined direction.

When the capping head 13 of the rotary multicapper 1 is to be changed, the controller 33 controls the rotation of the rotatable member 2 so that the capping head 13 is brought to a stop at the work head replacement position 34, whereupon the controller 33 controls the rotation of the drive shaft 51 to orient the angular positioning mechanism 31C so that it faces the capping head 13 at the work head replacement position 34. The mechanism 31 then rotates the connection 12, and the eject pin 48 is positioned to a particular position.

Under this condition, the rotation of the drive shaft 51 is controlled so that the first delivery mechanism 31A faces the capping head 13 at the work head replacement position 34 while the other or second delivery mechanism 31B faces the stocker 32. The first delivery mechanism 31A removes the capping head 13 from the spindle 11 while at the same time the second delivery mechanism 31B takes out a capping head of a different kind from the stocker 32.

Subsequently, when the both delivery mechanisms 31A, 31B have received the respective capping heads, the rotation of the drive shaft 51 is controlled so that the first delivery mechanism 31A faces the stocker 32 in order to store the removed capping head 13 within the stocker 32. At the same time, the second delivery mechanism 31B is brought to the work head replacement position 34 to attach the new capping head to the spindle 11.

When the new capping head is attached to the spindle 11 in this manner, the rotation of the rotatable body 2 is again controlled by the controller 33 to bring the next capping head 13 to the work head replacement position 34 where it is brought to a stop, thus repeating a similar operation.

Figure 8:
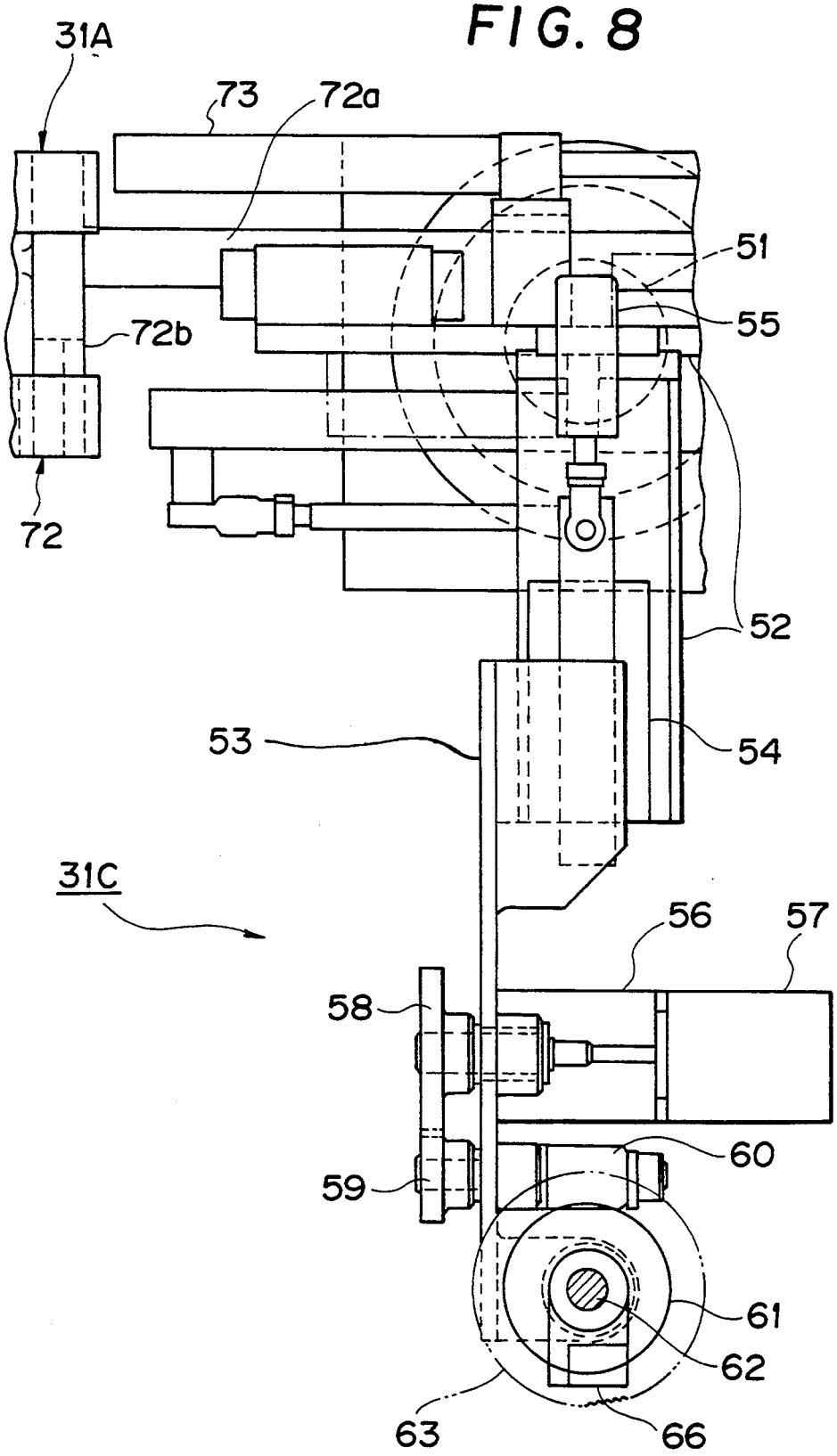
FIG. 8 is a top view of a rotary positioning mechanism 31C.

Referring to FIG. 8, the angular positioning mechanism 31C includes a rotary frame 52 which is driven for rotation by the drive shaft 51. A movable frame 53 is reciprocable upon the rotary frame 52 and is supported by a linear bearing 54 fixedly mounted on the rotary frame 52 so as to be reciprocable in the radial direction of the drive shaft 51 and in the horizontal direction. The reciprocating motion of the movable frame 53 is achieved by a cylinder unit 55 mounted on the rotary frame 52.

A servo motor 57 is mounted on the movable frame 53 through an interposed bracket 56, and the rotation of the servo motor 57 is transmitted through gears 58, 59 and a worm 60 to a worm wheel 61. The worm wheel 61 is fixedly mounted on the bottom of a rotary shaft 62 which is rotatably journalled and which is directed perpendicular to the free end of the movable frame 53. At its top end, the rotary shaft 62 carries a drive gear 63.

As shown in FIGS. 3 and 5, the drive gear 63 is capable of meshing with a gear 64 which is fixedly mounted on the fixing plate 41 which is in turn integral with the spindle 11. A sensor 66 (FIG. 8) such as a proximity switch or the like for detecting a positioning pin 65 (see FIG. 5) mounted on the fixing plate 41 is disposed on the foremost end of the movable frame 53. As will be described below, the positioning pin 65 is designed to position the eject pin 48 (FIG. 3) at a given position.

With the described arrangement, when it is desired to position the eject pin 48 at a given position by causing the angular positioning mechanism 31C to rotate the connection 12, the connection pin 25 of the rotary multicapper 1 is initially removed, allowing the individual spindles 11 to be rotatable relative to the rotatable body 2. Under this condition, the cylinder unit 55 is operated to rotate the drive shaft 51 with the movable frame 53 retracted toward the drive shaft 51, thereby orienting the drive gear 63 on the movable frame 63 toward the gear 64 which is integral with the spindle 11.

The cylinder unit 55 is then operated to drive the movable frame 53 forward until the drive gear 63 meshes with the gear 64, whereupon the servo motor 57 is started to rotate the drive gear 63, thereby allowing the gear 64 to rotate the spindle 11 and the connection 12. When the positioning pin 65 is detected by the sensor 66 as a result of the rotation of the connection 12, the controller 33 immediately stops the rotation of the drive gear 63. Under this condition, the eject pin 48 is positioned at a location which is offset by 90° with respect to a line joining the center of the rotary multicapper 1 and the center of the drive shaft 51 (see FIG. 4).

When the eject pin 48 is positioned at a given position in this manner, the cylinder unit 55 is operated to retract the movable frame 53, thus releasing the meshing engagement between the drive gear 63 and the gear 64.

Figure 9:
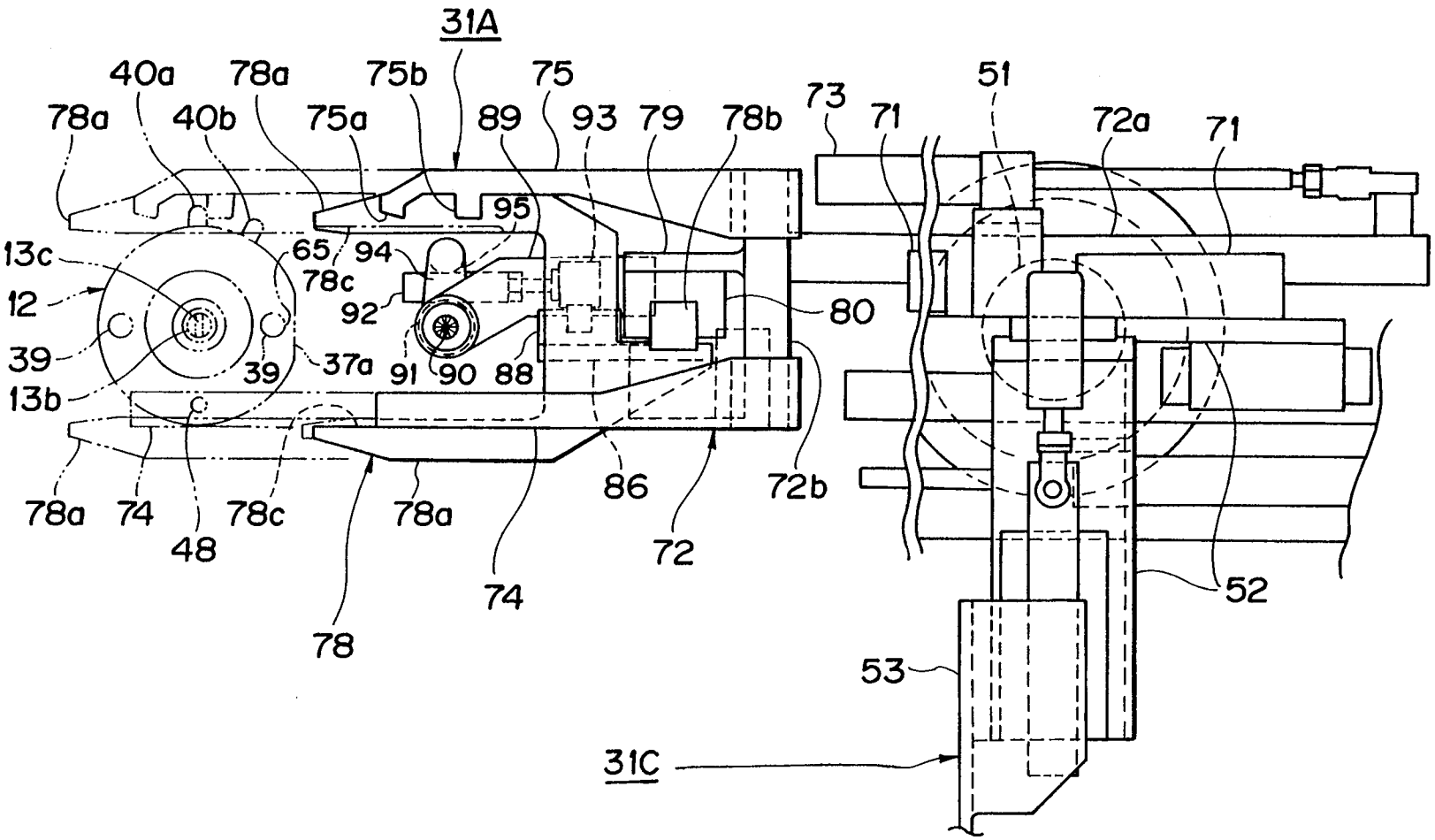
FIG. 9 is a top view of the first delivery mechanism 31A.
Figure 10:
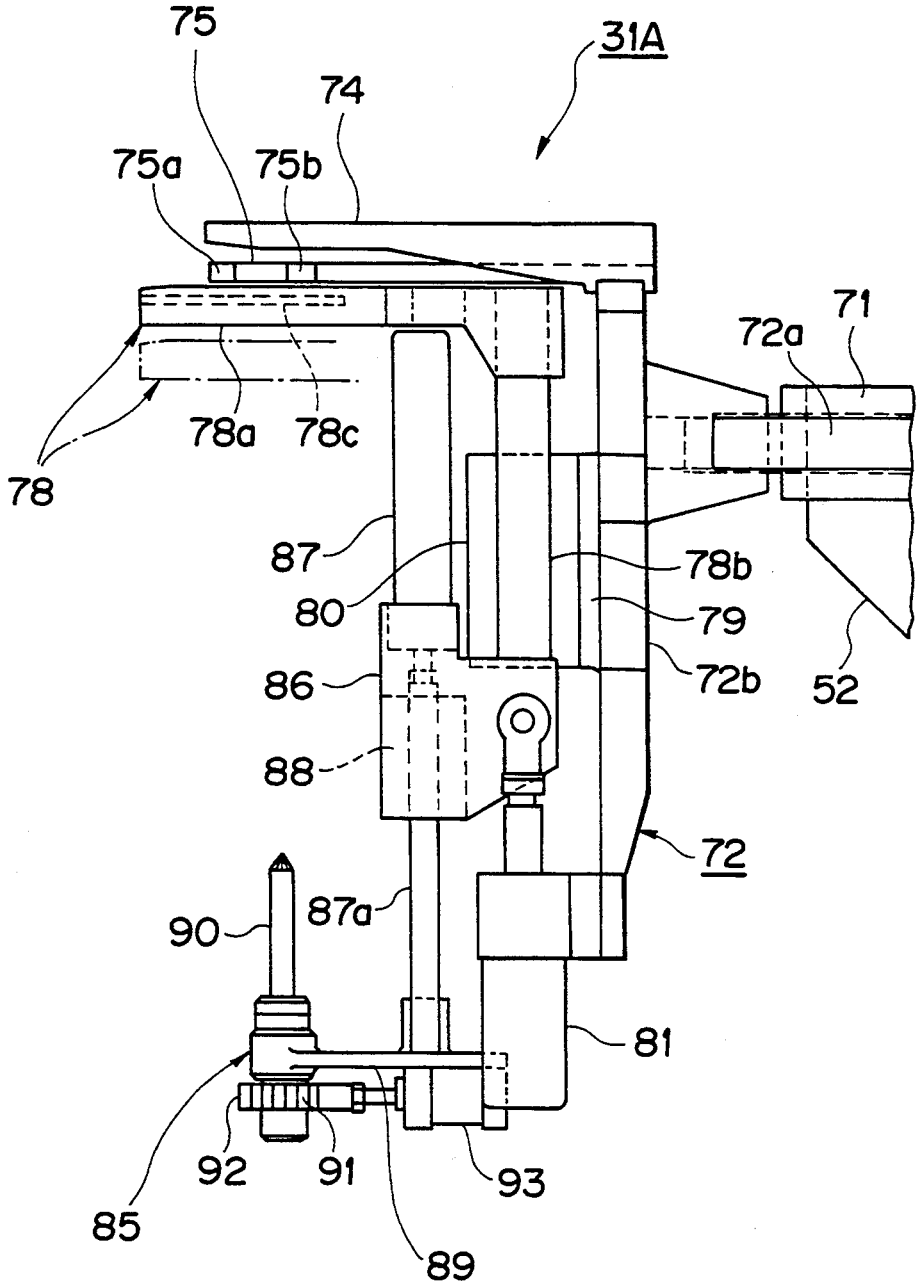
FIG. 10 is a side elevation of FIG. 9.

The first and the second delivery mechanisms 31A and 31B are constructed in an identical manner, and accordingly only the first delivery mechanism 31A will be described. Referring to FIGS. 9 and 10, a movable frame 72 is supported on the rotary frame 52 which is driven for rotation by the drive shaft 51, by a linear bearing 71 so as to be reciprocable in the radial direction of the drive shaft 51 and in the horizontal direction, in the same manner as the movable frame 53 mentioned above. The movable frame 72 is reciprocable by means of a cylinder unit 73 which is mounted on the rotary frame 52.

The movable frame 72 comprises a rod-shaped portion **72*a* which is supported by the linear bearing 71 so as to be reciprocable, and a vertically extending planar portion 72*b* which is integrally connected to the end of the rod-shaped portion 72*a*. The cylinder unit 73 mounted on the rotary frame 52 is connected to the terminal end, or the right-hand end, as viewed in FIG. 9, of the rod-shaped portion 72*a***.

Attached to the planar portion **72*b* of the movable frame 72 at its upper end and on one side thereof is a depressing member 74 which engages the eject pin 48, that is positioned at the given position mentioned above, and depresses it, while attached to the upper end of the planar portion 72*b* on the other side is a rotating member 75 including a pair of engaging pawls 75*a*, 75*b* engageable with the pair of projections 40*a*, 40*b* to rotate the connection plate 40**.

Toward its free end, the depressing member 74 has a bevelled surface on its underside (see FIG. 10), so that as the depressing member 74 is driven forward by the cylinder unit 73, the bevelled surface is effective to depress the eject pin 48. On the other hand, the engaging pawl **75*a* on the free end of the rotating member 75 engages the projection 40*a* to rotate the connection plate 40 counter-clockwise as viewed in FIGS. 9 and 4, after the depressing member 74 has depressed the eject pin 48, followed by the engagement of the engaging pawl 75*b* which is located rearward of the other pawl 75*a* on the rotating member 75 with the other projection 40*b* to continue the rotation of the connection plate 40, thus bringing the widened section 42*a* of the connection hole 42 formed in the connection plate 40 into alignment with the connection pin 39. Under this condition, the capping head 13 can be removed from the spindle 11**.

On the other hand, when the rotating member 75 is retracted by the cylinder unit 73 from this condition, the engaging pawl **75*a* on the rotating member 75 engages the projection 40*b* to rotate the connection plate 40 clockwise until the narrowed section 42*b* of the connection hole 42 formed in the connection plate 40 becomes engaged with the reduced diameter portion 39***a* of the connection pin 39. Thereupon, the capping head 13 is locked against removal from the spindle 11.

As the depressing member 74 continues to be depressed by the cylinder unit 73, the eject pin 48 is driven upward through the lock pin 45 under the resilience of the spring 46 until the lock pin 45 engages the through-opening 47*a* in the lock hole 47 formed in the connection plate 40, thus preventing a relative rotation of the connection plate 40 with respect to the capping head 13 and the spindle 11.

The planar portion 72*b* of the movable frame 72 is provided with an elevating member 78 which supports the opposite sides of the outer periphery of the flange 37 of the capping head 13 to drive the capping head 13 up and down while it is suspended.

The elevating member 78 comprises a horizontal forked portion 78*a* which supports the flange 37, and a rod-shaped portion 78*b* which depends downwardly from the other end of the forked portion 78*a* at the center thereof. The rod-shaped portion 78*b* is elevatably supported by a linear bearing 80 which is mounted on the planar portion 72*b* by means of a bracket 79. A cylinder unit 81 mounted on the planar portion 72*b* is connected to the lower end of the rod-shaped portion 78*b*, whereby the elevating member 78 can be driven up and down by the cylinder unit 81.

On its opposite sides, the inner surface of the forked portion 78*a* is formed with an elongate groove 78*c* which receives the outer periphery of the flange 37 of the capping head 13, as shown in FIG. 3, and the forked portion 78*a* can suspend the capping head 13 by supporting the opposite sides of the outer periphery of the flange 37 with the both grooves 78*c*.

As shown in FIG. 4, the forked portion 78*a* is centrally provided with a magnet 82, which attracts a flat surface 37*a* formed around the outer periphery of the flange 37 to prevent the capping head 73 from rotating relative to the forked portion 78*a* or from being disengaged. The flat surface 37*a* is located directly below the positioning pin 65, and therefore when the angular position of the connection 12 is positioned so that the positioning pin 65 directly faces the first delivery mechanism 31A, the flat surface 37*a* can be oriented to face the magnet 82.

The elevating member 78 is provided with rotating means 85 which rotates the pressure plate 13*b* to bring the projection 13*c* formed on the upper end of the pressure block 13*b* of the capping head 13 into engagement with the slit 26*a* formed in the lower end of the elevating rod 26 as the capping head 13 is connected to the spindle 11.

Referring to FIG. 10, the rotating means 75 comprises a bracket 86 mounted on the rod-shaped portion 78*b* of the elevating member 78, and a cylinder unit 87 mounted on the bracket 86. The cylinder unit 87 includes a cylinder rod 87*a* which is rectangular in cross section and which is supported by a linear bearing 88 secured to the bracket 86 in an elevatable manner.

An elevating plate 89 is fixedly connected to the lower end of the cylinder rod 87*a*, and has a drive shaft 90 rotatably journalled therein at a location immediately below the pressure block 13*b* of the capping head 13 which is suspended by the forked portion 78*a*. The drive shaft 90 has an upper conical end having an uneven surface so that when the upper end of the drive shaft 90 is held in abutment against a conical recess 13*d* (see FIG. 2) formed in the lower end face of the pressure block 13*b*, the rotation of the drive shaft 90 is effective to rotate the pressure block 13*b*.

The lower end of the drive shaft 90 extends through the elevating plate 89 to the downside thereof, with a pinion 91 mounted on the projecting end. The pinion 91 meshes with a rack 92, which is in turn connected to a cylinder unit 93 fixedly mounted on the lower surface of the elevating plate 89. As shown in FIG. 9, a bracket 94 mounted on the elevating plate 89 rotatably carries a roller 95, which is resiliently urged against the back surface of the rack 92, thus preventing a meshing engagement between the rack 92 and the pinion 91 from being broken.

Describing the operation of the first delivery mechanism 31A constructed in the manner mentioned above to remove the capping head 13 from the spindle 11, as the drive shaft 51 rotates to bring the first delivery mechanism 31A to a position where it opposes the capping head 13 in the work head replacement position 34, the movable frame 72 is at its retracted end position, the elevating member 78 is at its elevated end position and the elevating plate 89 is located at its lowermost end position. Before the first delivery mechanism 31A assumes such opposing relationship with the capping head 13, the angular positioning mechanism 31C has rotated the connection 12 to position the eject pin 48 at its position shown in FIG. 4.

When the movable frame 72 is now driven forward by the cylinder unit 73, the elevating member 78 is also driven forward integrally therewith, whereby the outer periphery of the flange 37 of the capping head 13, on its both sides, begin to be inserted into the elongate groove 78*c* formed in the forked portion 78*a*. As the movable frame 72 continues to be driven forward to cause the depressing member 74 to be driven forward integrally, the bevelled surface formed on the underside of the free end thereof is effective to depress the eject pin 48, whereupon the engaging pawls 75*a*, 75*b* on the rotating member 75 which is integrally driven forward together with the movable frame 72 successively engage the projections 40*a*, 40*b* on the connection plate 40, thus rotating the connection plate 40.

When the movable frame 72 reaches its foremost end, the widened section 42*a* of the connection hole 42 formed in the connection plate 40 is aligned with the connection pin 39, thus allowing the capping head 13 to be removed from the spindle 11. Also under this condition, the magnet 82 disposed centrally on the forked portion 78*a* attracts the flat surface 37*a* formed on the outer peripheral surface of the flange 37.

When this condition is reached, the cylinder unit 81 drives the elevating member 78 down, thus lowering the capping head 13 which is supported by the forked portion 78*a* thereof. As a consequence, the connection pin 39 on the capping head 13 is disengaged from the connection hole 42*a* in the connection plate 40 and thus is removed from the spindle 11.

Subsequently, the movable frame 72 is retracted, and the capping head 13 which is suspended from the forked portion 78*a* is carried out from its position directly below the spindle 11. The retracting movement of the rotating member 75 and the retracting movement of the depressing member 74 are then effective to return the connection plate 40 to its original position, whereupon the lock pin 45 engages the through-opening 47*a* of the lock hole 47 formed in the connection plate 40. When removing the capping head 13 from the spindle 11, there is no need to operate the rotating means 85, inasmuch as it is unnecessary to engage the projection 13c of the pressure block 13b with the slit 26a in the elevating rod 26. Subsequently, the capping head 13 removed by the first delivery mechanism 31A is stored within the stocker 32, while the other or second delivery mechanism 31B operates to mount a capping head of a different kind from the removed one on the spindle 11.

However, for the convenience of description, a mounting operation to mount the capping head 13 will be described with respect to the spindle 11 of the first delivery mechanism 31A which has just been emptied. When the rotation of the drive shaft 51 brings the first delivery mechanism 31A carrying the capping head 13 in suspended form into opposing relationship with the work head replacement position 34, the movable frame 72 is at its retracted end position, the elevating member 78 is at its lowermost position as is the elevating plate 89.

If the movable frame 72 is driven forward by the cylinder unit 73, the eject pin 48 is depressed by the depressing member 74 in the manner mentioned above, followed by the rotation of the connection plate 40 achieved by the rotating member 75 to bring the widened section 42a of the connection hole 42 formed in the connection plate 40 into alignment with the axis of the through-openings 36c, 41a for receiving the connection pin 39.

At this time, the capping head 13 as suspended by the forked portion 78a of the elevating member 78 which is driven forward integrally with the movable frame 72 is carried to a position immediately below the spindle 11 while the pair of connection pins 39 on the capping head 13 are located above and below the axis of the through-openings 36c, 41a and the widened section 42a.

The elevating member 78 can then be driven upward by the cylinder unit 81 to insert the connection pins 39 into the through-openings 36c, 41a and the widened section 42a, whereupon the magnet 82 on the flange 37 of the capping head 13 is effective to attract the spindle 11 to achieve an integral connection therebetween.

At this time, the projection 13c of the pressure block 13b and the slit 26a in the elevating rod 26 are not necessarily located for mutual engagement, and if the both cannot be engaged, the elevating rod 26 will be raised upward against the resilience of the spring 28.

In order to assure the engagement between the projection 13c and the slit 26a, the elevating plate 89 is initially raised by the cylinder unit 87, whereby the conical upper end of the drive shaft 90 is brought into abutting engagement against the conical recess 13d in the pressure block 13b. When this condition is reached, the rack 92 is driven either forward or rearward by the cylinder unit 93, thus rotating the pressure block 18b through 180° or more through the pinion 91. Since the elevating rod 26 is prevented from rotating, a rotation of the pressure block 13b through 180° or more is effective to bring the projection 13c and the slit 26a into meshing engagement with each other.

When the projection 13c and the slit 26a mesh in this manner, the elevating plate 89 is driven down to move the drive shaft 90 and the pressure block 13b away from each other, followed by a retracting movement of the movable frame 72 by the cylinder unit 73. Since the connection pins 39 of the capping head 13 are now inserted in the through-openings 36c, 41a and the widened section 42a, the capping head 13 cannot be retracted integrally with the forked portion 78a which holds it suspended, and accordingly the attraction acting between the flat surface 37a of the capping head 13 and the magnet 82 on the forked portion 78a is forcibly terminated, allowing only the forked portion 78a to be retracted leaving the capping head 13 behind.

As a result of the operation of the rotating member 75 and the depressing member 74 which retract integrally with the movable frame 72, the connection plate 40 is returned to its original position with the narrowed section 42b in the connection hole engaged with the reduced diameter portion 39a of the connection pin 39 and with the lock pin 45 engaged with the through-opening 47a of the lock hole 47 formed in the connection plate 40, thus blocking a free rotation of the connection plate 40.

It will be apparent that no actuation of the rotating means 85 is required when mounting the capping head on the spindle 11, depending on the variety of capping head where such capping head is devoid of a portion corresponding to the projection 13c.

Figure 11:
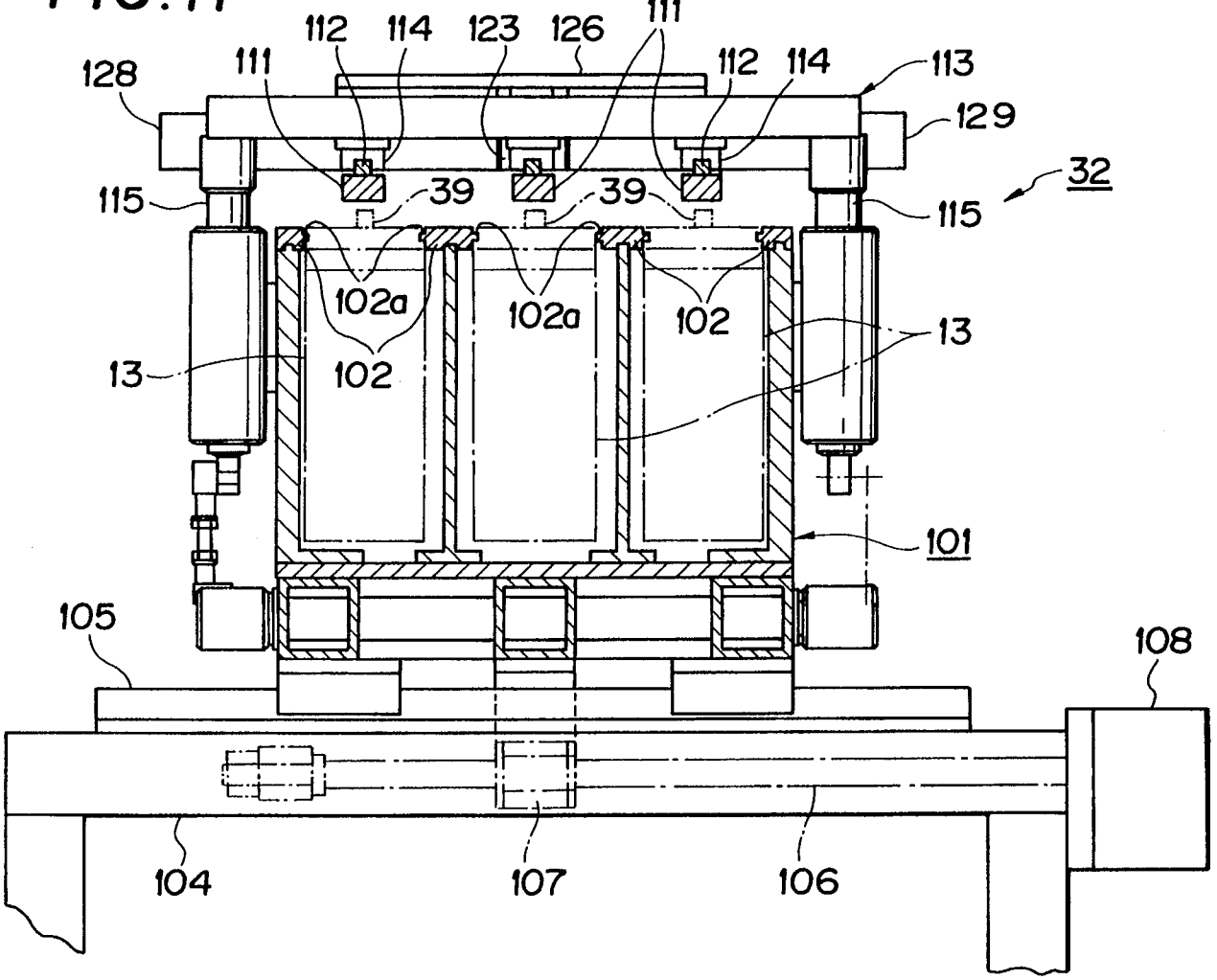
FIG. 11 is a section of a stocker 32.
Figure 12:
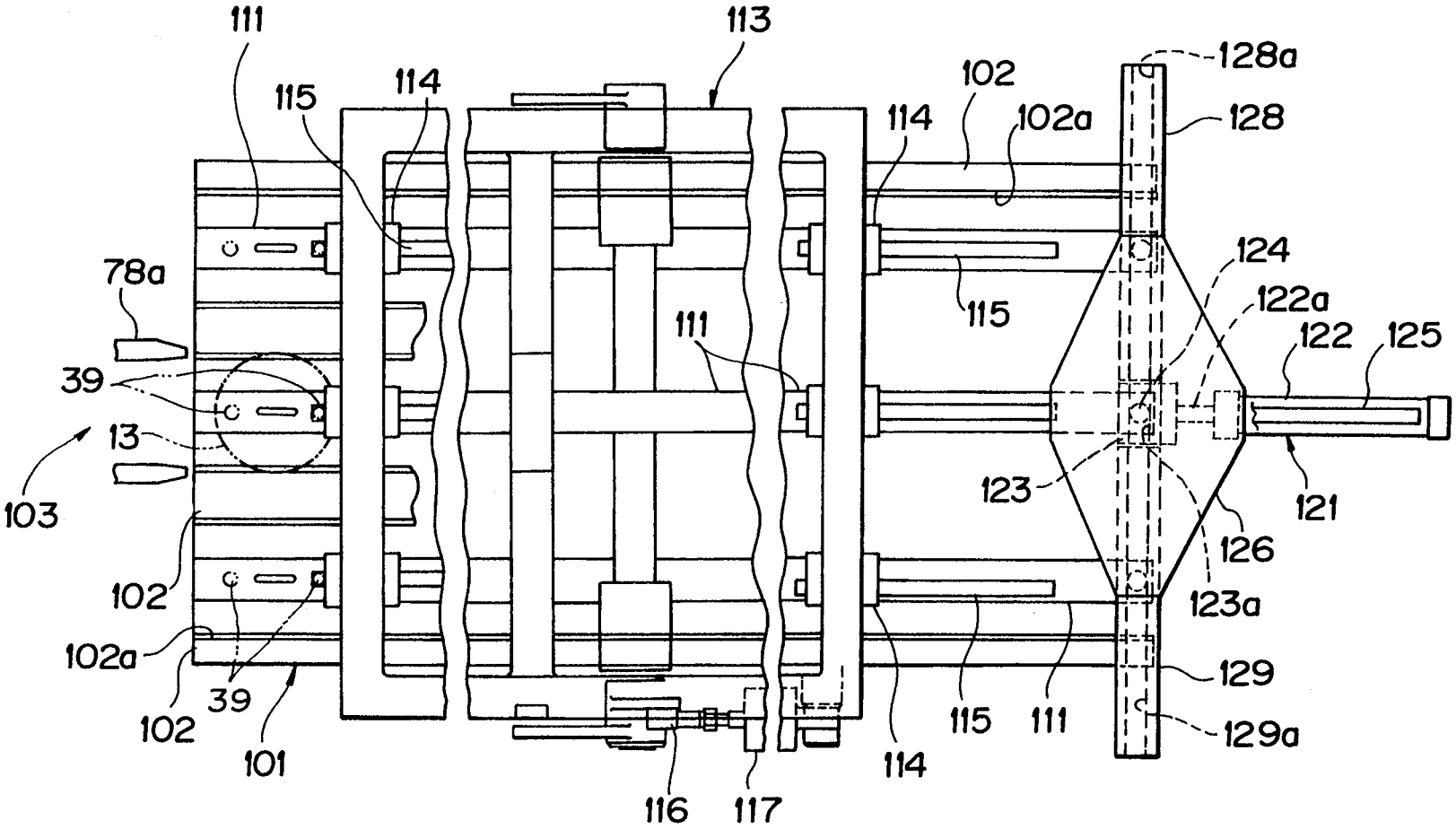
FIG. 12 is a plan view of FIG. 11.
Figure 13:
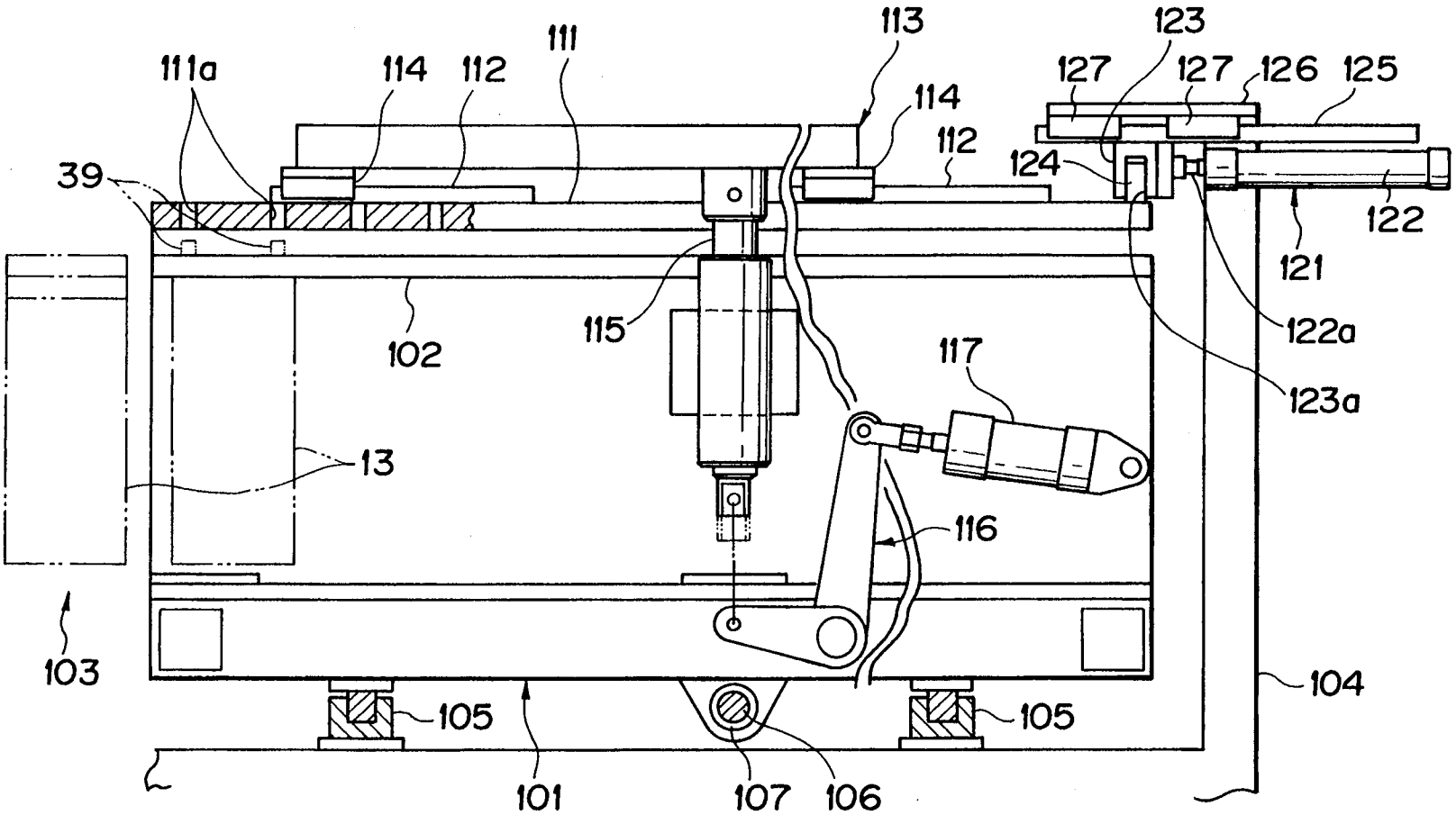
FIG. 13 is a side elevation of FIG. 11.

The construction of the stocker 32 will now be described. As shown in FIGS. 11 to 13, in the present embodiment, a containment 101 is designed to be capable of receiving three kinds of capping head 13 therein. By containing capping heads of a selected variety in a row horizontally with a given spacing therebetween, capping heads of different varieties can be contained therein in three rows which are parallel to each other. The containment 101 includes a total of four support members 102 which are disposed parallel to each other, extending along the rows of the capping heads 13. On the sides which oppose each other and at the top thereof, each support member 102 is formed with a flute-like step 102a against which the underside of the periphery of the flange 37 of the capping head 13 can abut on the both sides. In this manner, each capping head 13 is contained in the containment 101 as suspended from the respective support members 102.

The containment 101 which houses three rows of capping heads is designed to be movable in a horizontal direction which is perpendicular to the lengthwise direction of the rows in order to allow a capping head of a given variety to be positioned at a predetermined work head replacement position 103 (see FIGS. 12 and 13).

Specifically, referring to FIGS. 11 and 13, a pair of guide rails 105 extending perpendicular to the direction of rows of the capping heads 13 are disposed on a frame 104 in parallel relationship with each other, and the containment 101 is disposed in a movable manner on the guide rails 105. A threaded shaft 106 disposed parallel to the guide rails 105 is rotatably journalled on the frame 104 and is threadably engaged with a nut member 107 carried by the containment 101. As shown in FIG. 11, the threaded shaft 106 is connected to a servo motor 108 mounted on the frame 104, so that the motor 108 can drive the shaft 106 for rotation in either forward or reverse direction, thereby allowing the containment 101 to be driven back and forth through the nut member 107.

A reciprocation actuating member 111 is disposed above each row of capping heads 13, and is formed with engaging holes 111a, in its lower surface, which can be engaged by the pair of connection pins 39 of each capping head 13. The engaging holes 111a are disposed in pairs, and there are a number of pairs which is equal to the number of capping heads 13 contained in a row. Accordingly, when the connection pins 39 of all the capping heads 13 in one row are engaged with the holes 111*a* in the reciprocation actuating member 111, a constant spacing can be maintained between the individual capping heads 13 while at the same time preventing a rotation of the individual capping heads 13 relative to the support members 102 or the reciprocation actuating members 111.

When the connection pins 39 of all the capping heads 13 of one row are engaged with the holes 111*a* in the reciprocation actuating member 111, these connection pins 39 are aligned in one row lengthwise of the reciprocation actuating member 111. If the reciprocation actuating member 111 is driven back and forth under this condition, all the capping heads 13 can be simultaneously driven back and forth while maintaining a constant spacing between the individual capping heads.

At its opposite ends, each reciprocation actuating member 111 has sliders 112 fixedly mounted lengthwise on its upper surface, and each slider 112 is engaged with and supported by a linear bearing 114 secured to the lower surface of an elevating frame 113, thus allowing the respective reciprocation actuating member 111 to be mounted on the lower surface of the elevating frame 113 in a reciprocable manner.

The elevating frame 113 is fixedly connected to the top ends of elevating rods 115 which are elevatably disposed on the opposite sides of the containment 101. The lower end of each elevating rod 115 is connected through a crank mechanism 116 to a cylinder unit 117 mounted on the containment 101, thus enabling an elevating motion of the frame 113 by means of the cylinder unit 117.

The elevating motion of the frame 113 is effective to drive all the reciprocation actuating members 111 up and down simultaneously, but a reciprocation mechanism 121 which causes a reciprocating motion of the reciprocation actuating members 111 is adapted to cause a reciprocating motion of only that reciprocation actuating member 111 which is located at the work head replacement position 103.

The reciprocation mechanism 121 comprises a cylinder unit 122 fixedly mounted on the frame 104, and a channel-shaped connection member 123 mounted on the free end of the cylinder rod 122*a* of the cylinder unit 122 and having a connection groove 123*a*, which opens downward for engagement with one of engaging pins 124 located at the terminal end of the respective reciprocation actuating members 111 which is associated with the particular reciprocation actuating member 111 located at the work head replacement position 103.

A slider 125 is fixedly mounted on the upper surface of the connection member 123 to extend lengthwise of the reciprocation actuating member 111, and a fixing plate 126 is disposed above the slider 112 and is secured to the frame 104. The slider 125 is engaged with and supported by a linear bearing 127 which is mounted on the underside of the fixing plate 126.

The cylinder unit 122 is capable of causing a reciprocating motion of the reciprocation actuating member 111 through a stroke corresponding to a spacing between adjacent capping heads 13 through the connection member 123 and hence through its engaged pin 124. The engaging pin 124 on the reciprocation actuating member 111 has a length which is sufficient to prevent its disengagement from the connection groove 123*a* in the connection member 123 if the reciprocation actuating member 111 is driven up and down by the elevating frame 113.

A pair of fixed guides 128, 129 which have the same cross-sectional configuration as the connection member 123 are disposed on the opposite sides of the retracted end position, or the rightmost position as viewed in FIG. 12, of the connection member 123, and are secured to the lower surface of the fixing plate 126. The fixed guides 128, 129 include guide grooves 128*a*, 129*a*, which are disposed in alignment with the connection groove 123*a* in the connection member 123 as it is located at the rearmost position. Either one of the grooves 123*a*, 128*a*, 129*a* is engaged by the engaging pin 124 of each reciprocation actuating member 111.

In operation, when it is desired to take one of the capping heads 13 from the center row and to store the capping head 13 which has been removed from the rotary multicapper 1 in the row which is located to the right of the center row, the elevating frame 113 and the reciprocation actuating member 111 are driven down so that the respective engaging holes 111*a* are engaged by the connection pins 39 of the individual capping heads, and while all the capping heads are held fixed, the servo motor 108 is actuated to move the containment 101 so that the center row is located at the work head replacement position 103.

Then, the connection member 123 is located at its rearmost position with its connection groove 123*a* located in alignment with the guide grooves 128*a*, 129*a* in the fixed guides 128, 129, so that the engaging pin 124 of each reciprocation actuating member 111 which is engaged with one of the grooves 123*a*, 128*a*, 129*a* is freely movable within such groove. When the center row is located at the work head replacement position 103, only the engaging pin 124 of the reciprocation actuating member 111 for the center row is allowed to engage the connection groove 123*a* in the connection member 123. When so arranged, the first delivery mechanism 31A or the second delivery mechanism 31B which is empty is conveyed to the work head replacement position 103. Assuming that the second delivery mechanism 31B is conveyed to the work head replacement position 103, the movable frame 72 of this mechanism is at its rearmost end, the elevating member 78 is at its lower end position as is the elevating plate 89.

When the second delivery mechanism 31B which is empty is conveyed to the work head replacement position 103 and comes to a stop, the movable frame 72 is driven forward to allow the free end of the forked portion 78*a* of the elevating member 78 to be positioned contiguous with the free end of the support members 102 disposed on the opposite sides of the center row. Under this condition, the cylinder unit 122 of the reciprocation mechanism 121 is actuated to drive the connection member 123 forward, whereupon only the reciprocation actuating member 111 for the center row is allowed to be driven forward through the engaging pin 124 which is engaged with the connection groove 123*a* in the connection member 123.

This causes all the capping heads 13 in the entire row are driven forward through the connection pins 39 engaged with the engaging holes 111*a* in the reciprocation actuating member 111, and the foremost capping head 13 will be forced into the forked portion 78*a* to be suspended and supported thereby. The magnet 82 on the forked portion 78*a* is then effective to hold the flat surface 37*a* of the capping head 13 attracted thereto.

When the movable frame 72 is retracted and the second delivery mechanism 31B conveys one of the capping heads 13 from within the containment 101 of the stocker 32, the elevating frame 113 is driven upward to terminate the engagement between the holes 111*a* in the reciprocation actuating members 111 for all the three rows and the connection pins 39, whereupon the cylinder unit 122 causes the reciprocation actuating member 111 for the center row to be retracted to its original position. Subsequently, as the elevating frame 113 moves down, the holes 111*a* in the reciprocation actuating members 111 for all the three rows alone are again engaged with the connection pins 39, thus holding all the capping heads 13 stationary.

It will be noted that at this time, the capping heads 13 in the center row will be held stationary with one pitch advanced relative to the capping heads in the remaining reciprocation actuating members 111, and the latter capping heads 13 of these other rows will be held stationary at the same positions as before without being advanced relative to the associated reciprocation actuating member 111.

When all the capping heads 13 are held stationary in this manner, the servo motor 108 drives the containment 101 so that the right-hand, emptied row is located at the work head replacement position 103. In this instance, only the engaging pin 124 in the reciprocation actuating member 111 for the emptied right-hand row is engageable with the connection groove 123*a* in the connection member 123.

During the time the second delivery mechanism 31B takes one of the capping heads 13 out of the stocker 32, the first delivery mechanism 31A is removing the capping head 13 from the spindle 11, and when the drive shaft 51 rotates to allow the second delivery mechanism 31B to supply the capping head 13 which is taken out of the stocker 32 to the rotary multicapper 1, the first delivery mechanism 31A is then simultaneously operative to carry the capping head 13 which is removed from the spindle 11 of the rotary multicapper 1 to the work head replacement position 103.

When the first delivery mechanism 31A has removed the capping head 13 from the spindle 11, the movable frame 72 thereof is at its rearmost end, and the elevating member 78 is at its lowermost position as is the elevating plate 89. At the work head replacement position 103, as the movable frame 72 of the first delivery mechanism 31A is driven forward, the free end of the forked portion 78*a* of the elevating member 78 is disposed contiguous with the free end of the support members 102 disposed on the opposite sides of the right row. Thereupon, the elevating frame 113 is driven upward to disengage the connection pins 39 from the holes 111*a* in the reciprocation actuating members 111 of all the rows, allowing only the reciprocation actuating member 111 for the right row to be driven forward by the cylinder unit 122 through the connection member 123 and the engaging pin 124, and its free end will be located above the capping head 13 which is held suspended by the forked portion 78*a*.

Subsequently, as the elevating frame 113 is lowered, the engaging hole 111*a* at the free end of the reciprocation actuating member 111 for the right row becomes engaged with the connection pins 39 associated with the capping head 13 which is suspended from the forked portion 78*a*, as are the remaining connection pins 39 with all other engaging holes 111*a* for the remaining rows. The magnet 82 on the forked portion 78*a* of the first delivery mechanism 31A holds the flat surface 37*a* of the capping head 13 attracted thereto, so that the pair of connection pins 39 on the capping head 13 which is suspended from the forked portion 78*a* will be aligned with the pair of engaging holes 111*a* located at the free end of the reciprocation actuating member 111 for the right row, thus allowing these connection pins 39 to be smoothly engaged with such engaging holes 111*a*.

When the connection pins 39 of the capping head 13 which is suspended from the forked portion 78*a* becomes engaged with the holes 111*a*, the cylinder unit 122 causes the reciprocation actuating member 111 for the right row alone to be retracted, thus forcibly terminating the attracting action of the magnet 82 upon the flat surface 37*a*, allowing the capping head 13 suspended from the forked portion 78*a* to be transferred onto the support members 102.

Subsequently, as the movable frame 72 of the first delivery mechanism 31A is retracted, the resulting movement of the containment 101 positions the center row at the work head replacement position 103 again, and when the movable frame 72 of the first delivery mechanism 31A is driven forward for the next time, the free end of the emptied forked portion 78*a* of the elevating member 78 will be disposed contiguous with the free end of the support members 102 disposed on the opposite sides of the center row. The capping head 13 from the center row is then fed to and suspended from the forked portion 78*a* of the first delivery mechanism 31A in the same manner as mentioned above in connection with the second delivery mechanism 31B.

In the meantime, the second delivery mechanism 31B mounts the capping head 13 which is taken out of the right row onto the spindle 11, followed by a rotation of the rotatable body 2, whereby a removal of the capping head 13 from the spindle 11 which is then positioned at the work head replacement position 34 occurs anew.

In the described embodiment, the reciprocation mechanism 121 is arranged on the frame 104 so that a reciprocating movement of only the reciprocation actuating member 111 located at the work head replacement position 103 is allowed. However, a plurality of reciprocation mechanisms, which are equal in number to the number of reciprocation actuating members 111, may be provided in the containment 101 for separately reciprocating the respective reciprocation actuating members 111. Also, each reciprocation actuating member 111 may be separately driven up and down.

Figure 14:
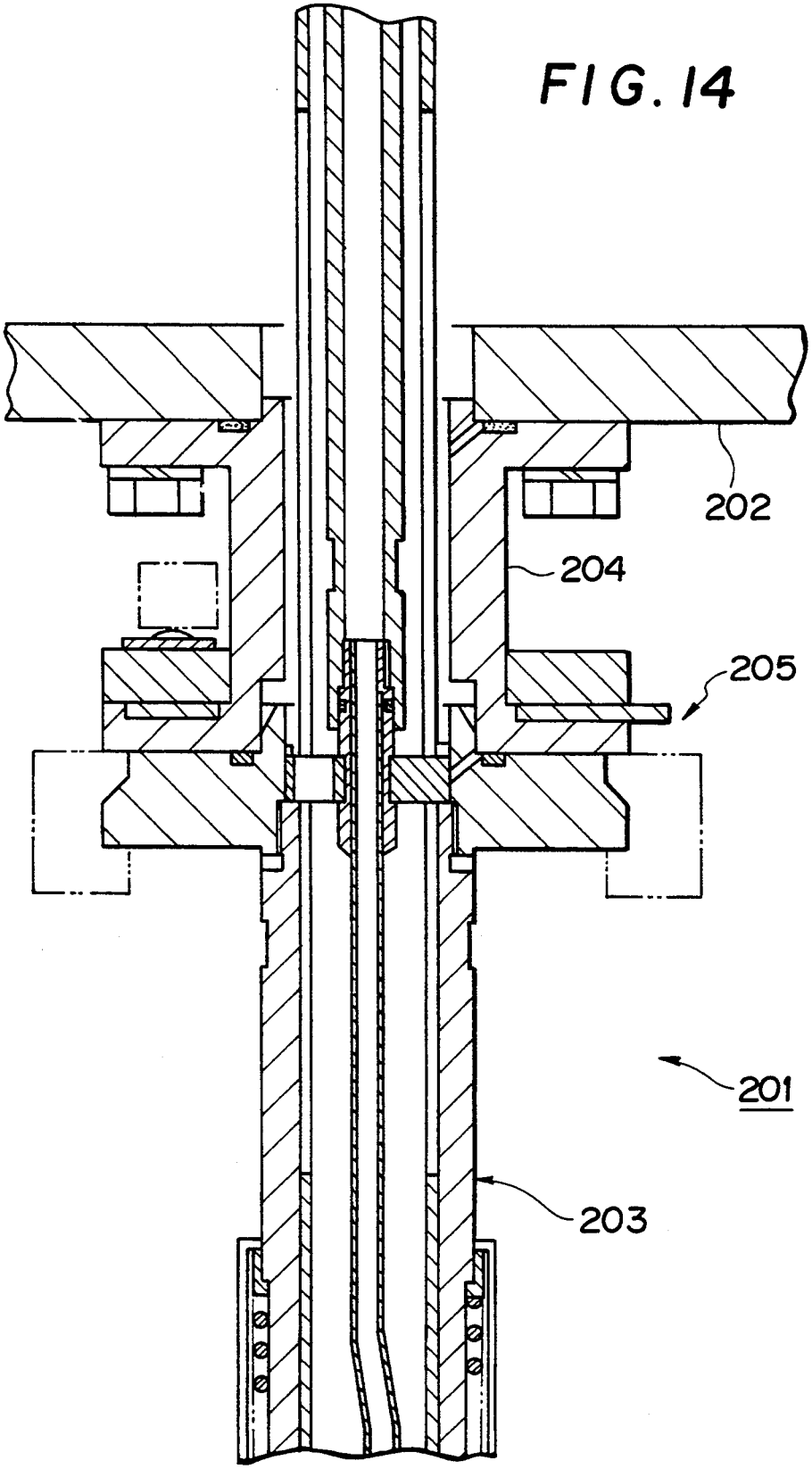
FIG. 14 is a section of an essential part of another embodiment of the invention.

FIG. 14 shows another embodiment of the invention as applied to a rotary filler 201, in contradistinction to the application of the invention to the rotary multicapper 1 as mentioned above.

The rotary filler 201 includes a tank 202 as a rotatable body, which is used to maintain a store of a filling liquid. The tank 202 is adapted to be driven for rotation by a drive shaft, not shown. A plurality of filling liquid nozzles 203 are detachably mounted in the bottom of the tank 202 at an equal interval circumferentially thereof as centered about the drive shaft. FIG. 14 shows only one nozzle 203. The nozzle 203 has a valve which is adapted to be opened by the opening of a vessel which is driven upward as carried by an elevating table, not shown, whereby the filling liquid which is contained in the tank 202 fills the vessel by gravity. A rotary filler 201 of such kind is well known in the art, and therefore no further detail will be described.

A cylindrical block 204 is secured to the bottom surface of the tank 202, and the nozzle 203 is detachably mounted on the lower portion of the block 204 through a connection 205. The connection 205 is fundamentally constructed in the same manner as the connection 12 described above in connection with the first embodiment. However, since it is not required that the nozzle 203 be rotated relative to the tank 202, or in other words, since the nozzle 203 is maintained in a given orientation with respect to the tank 202, the angular positioning means, which corresponds to the positioning pin 65 or gear 64 used in the above embodiment are omitted.

Similarly, the angular positioning mechanism 31C mentioned above is also omitted from the work head delivery mechanism 31, and because the valve 203 is not provided with the member which corresponds to the pressure block **13*b* of the capping head 13, the rotating means 85 is eliminated from the respective delivery mechanisms 31A, 31B. On the other hand, the stroke of the elevating member 78 of the delivery mechanisms 31A, 31B is chosen to be far greater than that used in the first embodiment in consideration of the filling nozzle 203**.

In other respects, the arrangement of the work head delivery mechanism 31 and the stocker 32 is substantially similar to that of the first embodiment, and such work head delivery mechanism 31 or stocker 32 may be utilized to change the filling nozzles 203 of the rotary filler 201 with filling nozzles of different kinds in an automatic manner.

In the described embodiment, the work head delivery mechanism 31 includes the first and the second delivery mechanism 31A, 31B, but one of these may be eliminated. Additionally, a robot may be used as the work head delivery mechanism. In this instance, the stocker 32 may be replaced by a simple shelf. Furthermore, a twist lock mechanism which is known in the art may be used to construct the connection 12.

While the invention has been disclosed in detail above in connection with several embodiments thereof, it should be understood that a number of changes, modifications and substitutions therein will readily occur to one skilled in the art without departing from the scope and spirit of the invention as defined by the appended invention, and therefore it is intended that such changes, modifications and substitutions are fully covered by the claims.

What is claimed is:

1. A rotary vessel processing system including a rotatable body for conveying vessels at a given interval, a plurality of work heads circumferentially spaced apart at an equal interval on the rotatable body for applying a processing operation to each of vessels which are conveyed by the rotatable body, and a connection provided between the rotatable body and each work head to permit an engagement and disengagement therebetween for detachably mounting each work head on the rotatable body; and a work head changer including a controller for controlling the rotation of the rotatable body so that each work head is successively and intermittently stopped at a predetermined work head replacement position, and a work head delivery mechanism for removing a work head which comes to a stop at the work head replacement position from the connection and for attaching a work head of another variety to the connection at an emptied location where the work head has been removed.

2. The invention according to claim 1 in which the connection comprises a connection half located on a part of the rotatable body, a connection half located on a part of the work head and disposed in overlapping relationship with the connection half on the rotatable body, a connection pin disposed in one of the connection halves, a reduced diameter portion formed on the connection pin at a given elevation, a ring-shaped connection plate rotatably disposed on the other connection half, and a connection hole formed in the connection plate, the connection hole including a widened section which permits the connection pin to extend therethrough and a narrowed section formed in continuity with the widened section for engaging the reduced diameter portion of the connection pin to prevent a disengagement of the connection pin from the connection plate.

3. The invention according to claim 2 in which the work head delivery mechanism comprises a rotary frame which is driven for rotation by a drive shaft, a movable frame disposed on the rotary frame so as to be engageable with and disengageable from the connection, an elevating member mounted on the movable frame in an elevatable manner for supporting the connection half located on the part of the work head as the movable frame moves toward the connection and for elevating the work head as suspended, and means for rotating the connection plate.

4. The invention according to claim 3 in which the elevating member includes a horizontally extending forked portion which supports opposite sides of an outer periphery of the connection half located on the part of the work head.

5. The invention according to claim 4, further including a magnet disposed on the forked portion for holding the connection half located on the part of the work head attracted thereto.

6. The invention according to claim 5 in which a peripheral surface of the connection half located on the part of the work head which is held attracted by the magnet is formed as a flat surface.

7. The invention according to claim 3 in which the connection plate is formed with a pair of projections which extend radially outward, and wherein the movable frame carries a rotating member having a pair of engaging pawls which engage the respective projections to rotate the connection plate, the engaging pawls engaging the projections to rotate the connection plate in a first direction so as to align the widened section of the connection hole formed in the connection plate with the connection pin as the movable frame moves toward the connection, the engaging pawls also engaging the projections to rotate the connection plate in an opposite direction to cause the narrowed section in the connection hole formed in the connection plate to be engaged with the reduced diameter portion of the connection pin as the movable frame is retracted from a position close to the connection.

8. The invention according to claim 2, further including a lock hole formed in the connection plate and having a through-opening, and a lock pin for engaging the through-opening of the lock hole to block rotation of the connection plate when the narrowed section of the connection hole is engaged with the reduced diameter portion of the connection pin to block disengagement of the connection pin from the connection plate.

9. The invention according to claim 8, further including an eject pin having a portion with a reduced diameter relative to the lock pin for forcing the lock pin out of the through-opening in the lock hole, and a narrowed portion in the lock hole formed in the connection plate in continuity with the through-opening of the lock hole and having a reduced width relative to the through-opening, the narrowed portion of the lock hole being effective to allow the connection plate to be rotated until the widened section of the connection hole engages the connection pin to make the connection pin disengageable from the connection plate while the eject pin forces the lock pin through the through-opening in the lock hole.

10. The invention according to claim 9 in which the work head delivery mechanism comprises a rotary frame which is driven for rotation by a drive shaft, a movable frame disposed on the rotary frame so as to be engageable with and disengageable from the connection, and an urging member disposed on the movable frame for engagement with the eject pin to displace it so that the eject pin forces the lock pin through the through-opening of the lock hole as the movable frame moves toward the connection.

11. The invention according to claim 10 in which the urging member has a bevelled surface which displaces the eject pin as the movable frame moves toward the connection.

12. The invention according to claim 1 in which the work head delivery mechanism includes a first and a second delivery mechanism which are operable in alternate fashion, the arrangement of the first and the second delivery mechanism being such that while one of the delivery mechanisms removes a first work head which has come to a stop at the work head replacement position from the connection, the other delivery mechanism takes a second work head which is distinct from the first work head from a stocker, and such that while said one delivery mechanism stores the first work head which is removed from the connection in the stocker, the other delivery mechanism attaches the second work head which is taken out of the stocker to the connection.

13. The invention according to claim 12 in which the connection comprises a connection half on a side of the rotatable body, a connection half on a side of the work head and disposed in overlapping relationship with the connection half on the rotatable body, a connection pin on one of the connection halves, a reduced diameter portion formed in the connection pin at a given elevation, a ring-shaped connection plate rotatably disposed on the other connection half, and a connection hole formed in the connection plate, the connection hole including a widened section which permits the connection pin to extend therethrough and a narrowed section formed in continuity with the widened section for engaging the reduced diameter portion of the connection pin to block a disengagement of the connection pin from the connection plate;

the first and the second delivery mechanisms having a common drive shaft, each of the first and the second delivery mechanisms comprising a rotary frame which is driven for rotation by the drive shaft, a movable frame mounted on the rotary frame so as to be engageable with and disengageable from the connection, an elevating member mounted on the movable frame in an elevatable manner for supporting the connection half on the side of the work head as the movable frame moves toward the connection and for elevating the work head up and down as it is suspended, and means for rotating the connection plate.

14. The invention according to claim 1 in which each of the work heads is separately rotatable with respect to the rotatable body, and the work head delivery mechanism includes an angular positioning means for rotating the connection as it comes to a stop at the work head replacement position and means for orienting such connection in a predetermined direction.

15. The invention according to claim 14 in which the angular positioning means comprises a rotary frame which is driven for rotation by a drive shaft, a movable frame mounted on the rotary frame so as to be engageable with and disengageable from the connection, a drive gear on the movable frame for meshing engagement with a gear on a connection half located on the rotatable body to rotate the connection, a positioning member disposed on the connection, and a sensor for detecting the positioning member when it assumes a particular position.

16. The invention according to claim 1 in which the rotary vessel processing system is a rotary multicapper and the work head is a capping head, the multicapper comprising a plurality of spindles disposed around a periphery of the rotatable body at an equal circumferential interval and disposed in an elevatable and rotatable manner, a capping head attached to a lower end of each spindle so as to be detachable through the connection, means for elevating each spindle, a gear on each spindle, a drive gear which is rotatable with respect to the rotatable body and a stationary member, and fixing means for fixing the drive gear to either one of the stationary member and the rotatable body.

17. The invention according to claim 16 in which the capping head comprises a capping head for roll-on capper, the capping head being detachably connected to the spindle through the connection and is driven for rotation by the spindle, the capping head including an outer peripheral portion which forms threads in an outer periphery of a cap, and a pressure block disposed in a shank portion of the outer peripheral portion;

the multicapper comprising an elevating rod fitted within each spindle in an elevatable and rotatable manner, means for blocking the rotation of the elevating rod relative to the rotatable body, means for urging the elevating rod downward, and engaging parts on the pressure block and the elevating rod which are engageable with each other;

the work head changer further comprising rotating means in the work head delivery mechanism for rotating the pressure block to achieve an engagement of the engaging parts on the pressure block and the elevating rod as the capping head is connected to the spindle.

18. The invention according to claim 17 in which the rotating means comprises an elevating plate which is disposed in an elevatable manner, a drive shaft rotatably journalled in the elevating plate and having an upper end brought into abutment against a lower end of the pressure block as the elevating plate is driven upward, and rotary drive means for rotating the drive shaft.

19. The invention according to claim 1 in which the rotary vessel processing system is a rotary filler, the work head is a filling liquid nozzle, and the rotatable body is a tank for storing a supply of a filling liquid.

20. The invention according to claim 1 in which the work head delivery mechanism stores a first work head which has been removed from the connection in a stocker and also takes a second work head which is distinct from the first work head out of the stocker for attachment to the connection, the stocker comprising a containment for containing a plurality of first work heads in one row at a given interval and for storing a plurality of second work heads in another row which is parallel to the first row at a given interval, a reciprocation actuating member associated with each row of work heads and having an engaging portion which is engageable with an engaging portion associated with individual work heads of each row to position the respective work heads, an elevating mechanism for performing an elevating motion of each reciprocation actuating member to engage or disengage the engaging portions on the reciprocation actuating member with the engaging portions on the respective work heads, and a reciprocation mechanism for causing a reciprocating movement of each reciprocation actuating member by an amount corresponding to the interval between adjacent work heads to displace a particular work head which is engaged with the engaging portion of the respective reciprocation actuating member.

* * * * *